United States Patent [19]

Ziaylek, Jr.

[11] 4,367,858

[45] Jan. 11, 1983

[54] NOZZLE BRACKET MOUNT

[76] Inventor: Theodore Ziaylek, Jr., 140 Riverview Dr., Yardley, Pa. 19067

[21] Appl. No.: 213,141

[22] Filed: Dec. 4, 1980

[51] Int. Cl.[3] ..... B05B 15/06

[52] U.S. Cl. ..... 248/75; 248/314

[58] Field of Search ..... 248/75, 79, 314, 226.3, 248/534, 533; 239/525, 283, 282; 138/106; 269/254 R

[56] References Cited

U.S. PATENT DOCUMENTS

| | | | |
|---|---|---|---|
| 1,352,810 | 9/1920 | Hunt | 248/226.3 X |
| 2,050,510 | 8/1936 | Thoms et al. | 248/70 |
| 2,179,153 | 11/1939 | Jones | 269/254 R |
| 2,464,958 | 3/1949 | Allen | 248/75 |
| 2,805,832 | 9/1957 | Weindel | 248/226.3 |
| 3,499,626 | 3/1970 | Barker | 248/75 |
| 3,734,439 | 5/1973 | Wintz | 248/314 X |

*Primary Examiner*—Ramon S. Britts

*Assistant Examiner*—Ramon O. Ramirez

*Attorney, Agent, or Firm*—Frederick A. Zoda; John J. Kane; Albert Sperry

[57] ABSTRACT

A mounting device for fire hose nozzles of the pistol-grip-type is mountable upon a fire truck or similar vehicle. Centrally disposed in the device is a holster of soft, compressible rubber or similar material, having a tubular form and inclined or canted to accommodate the pistol-grip-type handle of a fire hose nozzle. The holster is protectively enclosed by front and back plates, which can be drawn toward each other so as to reduce the width of the holster, to permit it to accommodate pistol-grips on fire engine hose nozzles of various makes and sizes. A supporting bracket is attachable to one of the retaining plates, and is adapted to be attached to an adjacent surface of the vehicle, in any of various positions, including a position in which the bracket is spaced away from the associated back plate by a stand-off sleeve or spacer.

10 Claims, 4 Drawing Figures

NOZZLE BRACKET MOUNT

BACKGROUND OF THE INVENTION

1. Field of the Invention

The present invention falls in the general category of supports for nozzles, especially the nozzles of fire hoses. More particularly, the invention has reference to supports or sockets for hose nozzles of the pistol-grip-type, wherein the nozzle socket can be adjustably increased or alternatively reduced in respect to its cross-sectional area, whereby to permit it to snugly receive any of various makes or sizes of pistol-grips.

2. Description of the Prior Art

Heretofore, sockets or supports have been devised for receiving the nozzles of fire hoses, but one of the problems that have been encountered is that the handles of fire hose nozzles vary widely in respect to their size, especially with respect to the cross-sectional area or width. These handles vary in this manner because they are made by different manufacturers, and standardization of the pistol-grip handles has not been achieved or, for that matter, even suggested.

As a result, it is necessary to either eliminate nozzle supports, or alternatively, the supports must be especially made, to receive only the handles of a particular product in this field. This has proved undesirable, especially since it is entirely possible that a fire company or rescue squad may, from time to time, change equipment and may, for example, buy new fire hoses or nozzles that cannot be accommodated in the nozzle supports already incorporated as part of their vehicular equipment.

Accordingly, it is regarded as important, and a desirable advance in this field, to provide a nozzle mount that will accommodate any of the various, best known pistol-grip nozzle handles presently in use by fire companies or rescue squads.

SUMMARY OF THE INVENTION

Summarized briefly, the present invention includes a soft, resilient socket or holster, formed with an end-to-end bore adapted to receive the pistol-grip of the nozzle handle, and inclined obliquely to a saddle portion formed at one end of the bore. The saddle portion is adapted to receive the nozzle body, and since the pistol-grip of a nozzle of this type extends obliquely to the length of the nozzle itself, the socket is correspondingly extended obliquely to the general plane of the saddle portion thereof.

The socket or holster portion of the invention is adapted to be disposed between and in effect embraced by a pair of confronting, flanged retaining plates, having registering openings adapted to receive screws or equivalent fasteners that extend therebetween. The plates, when disposed in embracing relation to the socket or holster portion, can be drawn toward each other in such fashion as to compress the material of the socket, thereby to reduce the effective width of the nozzle-handle-receiving bore. In this way, the socket or holster portion of the device is capable of snugly but releasably engaging the pistol-grip handles of various makes of nozzles, without regard to physical differences in the dimensions of said handles. A single device is thus adapted to receive a variety of pistol-grip nozzle handles.

A flanged bracket is adapted to be secured to one of the retaining plates, and can be mounted in any of various ways, according to the particular mounting surface on which the nozzle bracket mount constituting the present invention is to be disposed. Said mounting surface normally would be a ledge or other support surface of a truck or rescue vehicle. In some instances, it may be desired to space the holster portion away from the mounting surface, and in this event, spacer sleeves can be used to physically locate the retaining plates (and hence the socket itself) in spaced relation to the mounting surface.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

and

Figure 4:
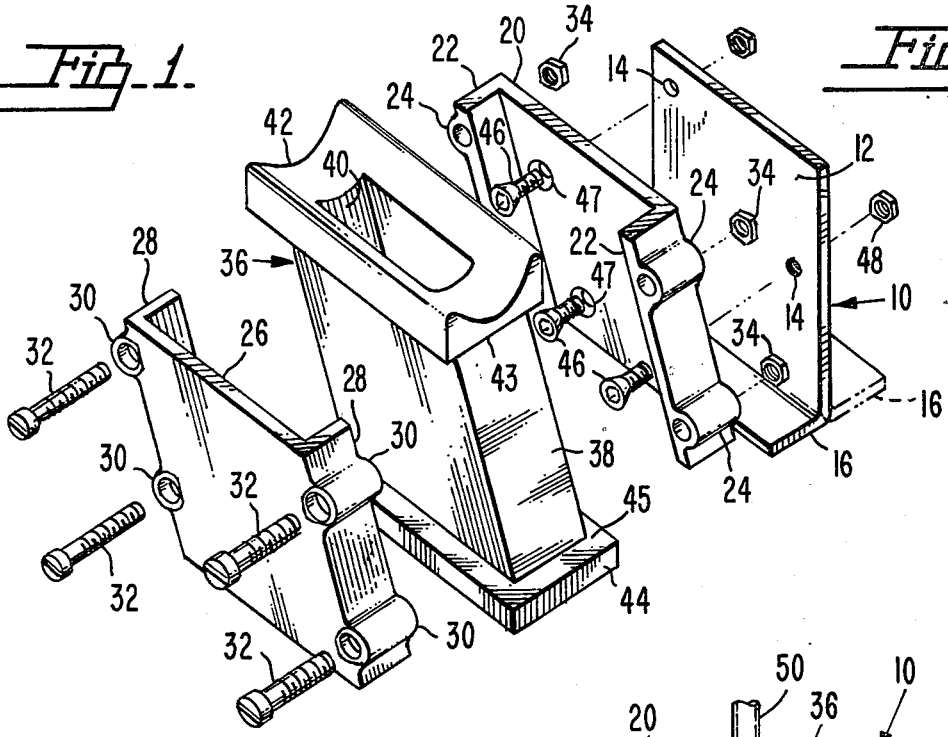
Figure 3:
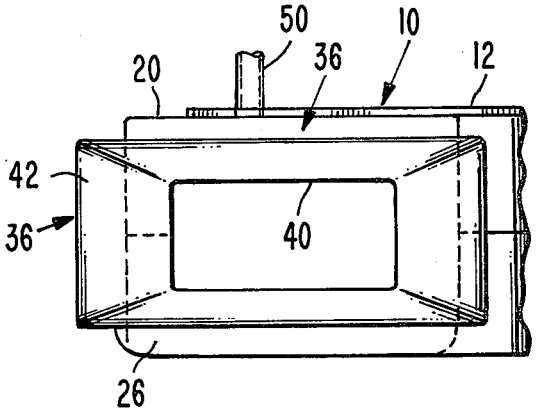
FIG. 3 is a top plan view of the device in which a portion has been broken away.

FIG. 4 is an exploded perspective view thereof.

DESCRIPTION OF THE PREFERRED EMBODIMENT

The reference numeral 10 has been applied generally to an angle bracket on which the nozzle mount constituting the present invention will ordinarily be supported. The bracket 10, in the preferred embodiment (see FIG. 4) comprises a flat, rectangular, rigidly constituted support plate 12 having, in the illustrated embodiment, three widely spaced openings 14.

Integral with the support plate 12, at one end thereof, is a base flange 16 disposed at right angles to the plane of the support plate, and having a pair of openings 18 adapted to receive mounting screws, not shown, whereby the bracket can be secured to the surface of a fire truck or similar vehicle.

Figure 2:
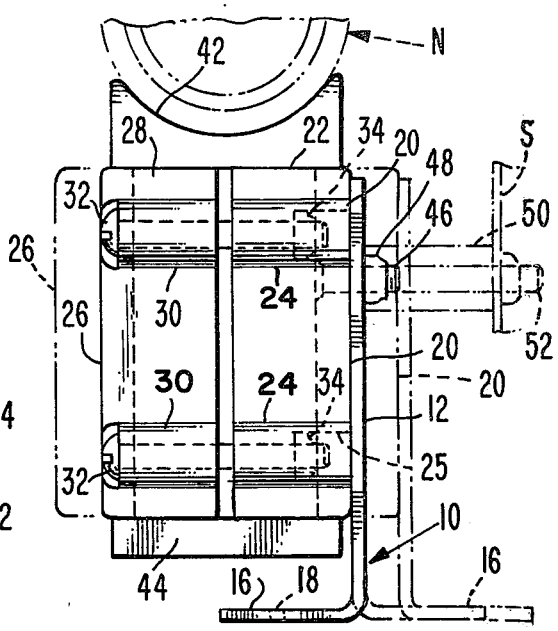
FIG. 2 is a view of the nozzle bracket mount as seen in elevation from the rear, that is, from the right of FIG. 1, the nozzle again being shown fragmentarily and in dotted lines, the retaining plates being shown in dotted lines as they appear when the socket is to be left in an uncompressed condition.

As will be noted from FIG. 2, the bracket can be reversed, so that the flange 16, instead of extending under the nozzle mount, can extend away therefrom as shown in dotted lines in FIG. 2.

The nozzle mount proper includes a first or rear retaining plate 20, integrally formed along its opposite side edges with forwardly projecting side flanges 22 each of which has a pair of spaced, parallel screw-receiving sleeves 24 formed with counter bores 25 (see FIG. 2).

A second or front retaining plate 26 is shaped similarly to the rear plate, and has rearwardly projecting side flanges 28, 28 each of which is formed with spaced sleeves 30 adapted to register with the sleeves 24 of plate 20.

The plates are adapted to be connected through the provision of screws 32, which extend through the smooth-walled bores of the sleeves 30, 24, and which are adapted to threadedly engage nuts 34 seated within the counter bores 25. The nuts 34 and counter bores 25 are correspondingly shaped, in a manner to prevent rotation of the nuts, whereby the rotation of the screws 32 is effective to draw the plates 20, 26 toward each other.

A holster or socket portion 36 is molded as a single piece, from soft rubber or similar resilient, readily compressible material. The socket portion 36, in the preferred embodiment, includes a body 38 which externally is of rectangular cross-section, said body 38 having an end-to-end bore 40 also of rectangular cross-section in the preferred embodiment of the invention. The bore 40 is adapted to receive the pistol-grip handle H of a conventional fire hose nozzle N.

At one end, the socket 36 is integrally formed with a saddle or seat 42 for the nozzle body, said seat being upwardly concavely formed to receive the nozzle. A nozzle of this type is generally of circular cross-section, and thus the nozzle seats snugly within the saddle and is held against lateral deviation therefrom when so engaged.

Figure 1:
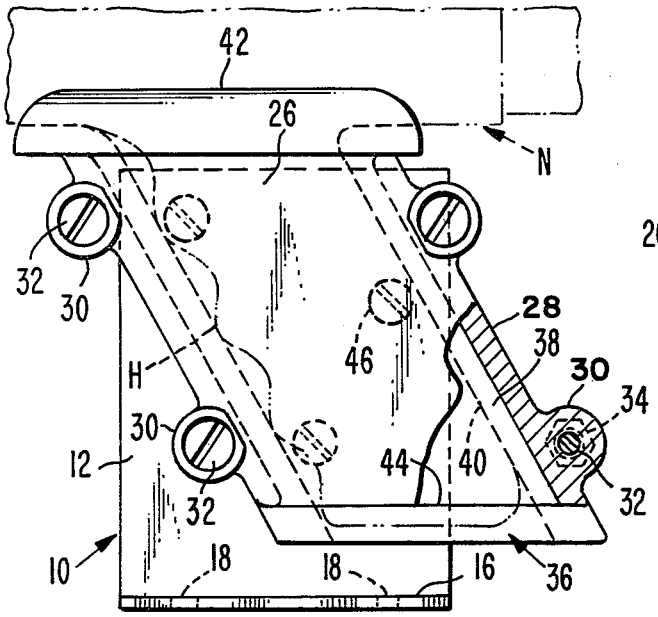
FIG. 1 is a view partly in side elevation and partly in section, of a nozzle bracket mount constructed according to the present invention, a nozzle having a pistol-grip handle being illustrated fragmentarily and in dotted outline.

At its other end, the socket 36 is formed with a peripheral, outwardly projecting lip 44. Lip 44, as will be noted from FIG. 1, projects below the adjacent ends of the retaining plates, 20, 26, and as will also be noted, from FIGS. 1 and 2, the retaining plates at their other ends engage under the saddle. Thus, the retaining plates are in effect held by the confronting shoulders 43, 45 of the saddle and lip respectively, said shoulders serving as abutments limiting the retaining plates against endwise movement in respect to the socket 36.

In use of the invention, the retaining plate 20 would first be secured to the support bracket 10, through the provision of screws 46 adapted to extend through openings 47 formed in the back retaining plate 20. The screws 46 engage nuts 48, whereby the retaining plate is fixedly secured to the bracket. As will be noted from FIGS. 2 and 4, openings 47 are counter-sunk to receive the heads of the screws 46, so that said heads will be flush with the inner surface of the retaining plate 20, and will not extend into the material of the soft rubber holster or socket 36.

In any event, if it is assumed that the desired mounting of the device is one in which the flange 16 extends under the holster as shown in full lines in FIG. 2, it is only necessary now to secure the flange 16 to the adjacent mounting surface of the truck or other vehicle, by fasteners extending through the openings 18. The bracket may of course be mounted before the rear retaining plate 20 is secured thereto.

Then, the socket 36 is disposed between the plates, and in its uncompressed state may be relatively wide, that is, the socket when not compressed may have a bore 40 which is of maximum width. Under these conditions, the bore may receive a pistol-grip handle H which is also relatively thick or wide. If this be the case, the screws 32 need not be turned to an extent necessary to bring the retaining plates 20, 26 any closer than is shown in dotted lines in FIG. 2.

If, on the other hand, the pistol-grip handle H is thinner, as would be true if it were the product of another manufacturer, then it would be desired to rotate the screws 32 to an extent, for example, that would bring the retaining plates to the full line position shown in FIG. 2. In these circumstances, the socket 36 is compressed widthwise, to reduce the transverse dimension of the bore 40. This causes the bore to accommodate a pistol-grip handle that is relatively thin.

Obviously, a wide variety of adjustments can be made, between the full and dotted line positions of the retaining plates shown in FIG. 2, these being the extreme positions in the illustrated example of the invention.

In some instances, it may be desired to space the retaining plates outwardly from the adjacent mounting surface of the vehicle. In these circumstances, one would use spacers 50 in the form of sleeves adapted to receive screws 52. The screws 52 would be longer than the screws 46 and would be used in place of the screws 46, in these circumstances, thus locating the first retaining plate 20 in spaced relation to the support plate 12 of the mounting bracket.

It is also possible to dispense with the mounting bracket, by attaching the plate 22 directly to the surface of the vehicle. Again, one might in these circumstances use the spacer sleeves 50 to locate the retaining plate outwardly from the mounting surface S.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A support for a hose nozzle having a pistol-grip handle, comprising:

(a) first and second, confronting retainer plates;

(b) means extending between and connecting said plates for adjustment toward and away from each other; and (c) a socket having a bore adapted to receive a pistol-grip handle of a hose nozzle, said socket being adapted for compression between the retaining plates when the plates are drawn toward each other, whereby to reduce the transverse dimension of the bore, thus to accommodate the bore to receiving pistol-grip handles of differing widths, said socket being formed at one end with a saddle adapted to supportably receive the body of said nozzle in a position in which the pistol-grip handle of the nozzle extends into the bore of the socket.

2. A suppot as in claim 1 wherein the saddle has a concave outer surface providing a seat for the body of the nozzle.

3. A support for a hose nozzle having a pistol-grip handle, as in claim 2, wherein the seat has a shoulder engaging the retaining plates at one end, the socket having an outwardly projecting lip at its other end, engaging the other ends of the retaining plates, said shoulder and lip defining abutments restraining the retaining plates against movement longitudinally of the bore.

4. A support for a hose nozzle as in claim 3 wherein the bore of the socket has its length disposed obliquely to the general planes of the lip and shoulder.

5. A support for a hose nozzle having a pistol-grip handle, comrprising:

(a) first and second, confronting retainer plates;

(b) means extending between and connecting said plates for adjustment toward and away from each other; and (c) a socket having a bore adapted to receive a pistol-grip handle of a hose nozzle, said socket being adapted for compression between the retaining plates when the plates are drawn toward each other, whereby to reduce the transverse dimension of the bore, thus to accommodate the bore to receiving pistol-grip handles of differing widths, said socket being formed with confronting abutments disposed adjacent opposite ends of the socket, said retaining plates having end edges engaged against said abutments to limit the retaining plates against movement longitudinally of the socket.

6. A support for a hose nozzle as in claim 5 wherein said socket includes a saddle at one end and a lip at its other end, the abutments being formed on the saddle and lip respectively, the saddle being adapted to receive the body of a hose nozzle.

7. A support for a hose nozzle as in claim 6 wherein the saddle and lip are disposed in parallel planes oblique to the length of the socket.

8. A support for a hose nozzle having a pistol-grip handle, comprising:

(a) socket means having a bore adapted to receive a pistol-grip handle of a hose nozzle and adapted to be compressed in a direction transversely of the bore to reduce the transverse dimension of the bore, thus to accommodate the bore to receiving pistol-grip handles of differing widths, said socket means having a saddle at one end of and extending angularly to the length of the bore, said saddle adapted to supportably receive the body of the nozzle in a position in which the pistol-grip handle of the nozzle extends into the bore; and (b) means for compressing the socket means to reduce the transverse dimension of the bore.

9. A support for a hose nozzle as in claim 8, wherein the socket means includes a body in which the bore is formed, said saddle extending beyond one end of the body and said compressing means being confined to the body and terminating short of the saddle, whereby to limit to said body the compressive force exerted by said compression means.

10. A support for a hose nozzle as in claim 8 wherein the saddle is formed with a seat for the nozzle supported thereby, said seat having a transversely concave surface onto which said bore opens, said surface of the nozzle having its length extending angularly to the length of the bore.

* * * * *